United States Patent [19]

Slater

[11] Patent Number: 4,586,879

[45] Date of Patent: May 6, 1986

[54] WELL PUMPING UNIT

[76] Inventor: Frank W. Slater, P.O. Box 186, Durant, Okla. 74701

[21] Appl. No.: 591,335

[22] Filed: Mar. 19, 1984

[51] Int. Cl.[4] ..... F04B 17/00; F16C 1/10

[52] U.S. Cl. ..... 417/411; 417/415; 92/137; 74/41; 74/108; 74/582

[58] Field of Search ..... 417/411, 415; 92/137; 74/41, 108, 582

[56] References Cited

U.S. PATENT DOCUMENTS

| | | | |
|---|---|---|---|
| 420,692 | 2/1890 | Miller | 74/41 |
| 797,672 | 8/1905 | Drennen | 74/108 |
| 1,269,343 | 6/1918 | Wacker | 74/41 |
| 1,620,795 | 3/1927 | Black | 74/108 |
| 1,649,078 | 11/1927 | Ratigan | 74/582 X |
| 2,087,785 | 7/1937 | Sjolseth | 74/41 X |
| 2,555,574 | 6/1951 | Crawford | 92/137 |

FOREIGN PATENT DOCUMENTS

| | | | |
|---|---|---|---|
| 2385911 | 12/1978 | France | 417/411 |

OTHER PUBLICATIONS

Blue Sky Water Supply, Blue Sky Water Supply Co., Billings, Mt., 12/6/1982.

*Primary Examiner*—Carlton R. Croyle

*Assistant Examiner*—Theodore W. Olds

*Attorney, Agent, or Firm*—Harvey B. Jacobson; Clarence A. O'Brien

[57] ABSTRACT

A well pumping unit for use in association with an oil well, water well or the like having a downhole pump operated by a reciprocating pump rod with the pumping unit including a pair of large diameter rotatable wheels independently supported from upstanding supports on a deck, platform or skid with the wheels being interconnected by a pin to which a cable for operating the pump rod is attached. The cable is entrained over a series of pulleys and anchored to a supporting structure with one of the pulleys being a traveling pulley having a cable attached thereto extending over a head pulley and connected with the pump rod for reciprocating the pump rod when the wheels are rotated. The pin interconnecting the wheels is received in one of a plurality of radially spaced pairs of openings to enable the stroke of the pump to be varied by varying the radial position of the pin in relation to the rotational axis of the wheels. The wheels are driven by an electric motor with small pulleys and drive belts engaged with the large diameter wheels. A photovoltaic cell assembly may be used to charge batteries for storing electrical energy to drive the electric motor for powering the well pumping unit.

14 Claims, 5 Drawing Figures

WELL PUMPING UNIT

BACKGROUND OF THE INVENTION

1. Field of the Invention

The present invention generally relates to a well pumping unit and more specifically to a unit having an adjustable stroke capability and including a pair of large diameter grooved wheels in the form of pulleys driven by an electric motor having a drive shaft extending from each end and provided with a small grooved pulley driving the large diameter grooved wheels through a belt drive with a cable attached to the large pulleys at a radially adjustable point and entrained over a series of pulleys including one traveling pulley having a cable attached thereto and extending over a head pulley and connected to the pump rod to enable utilization of a relatively small horsepower motor to operate the pump together with a solar powered unit to provide electrical energy for operating the motor.

2. Description of the Prior Art

Various types of pumping units, pump jacks and the like have been utilized for reciprocating a pump rod which extends downwardly into a well bore for actuating a downhole pump. Various rather complex mechanisms have been provided to counterbalance the weight of the fluid column being lifted and various mechanisms have been provided to reduce the shocks encountered and various efforts have been made to increase the overall efficiency of such pumping units. The following U.S. patents are exemplary of the development of the state of the art to which this invention pertains.

U.S. Pat. No. 1,686,154
U.S. Pat. No. 1,798,780
U.S. Pat. No. 1,982,634
U.S. Pat. No. 2,555,574
U.S. Pat. No. 2,977,808
U.S. Pat. No. 3,515,008
U.S. Pat. No. 4,301,688

SUMMARY OF THE INVENTION

An object of the present invention is to provide a well pumping unit including a pair of large diameter wheels driven by a small horsepower electric motor or the like and connected with a cable system for reciprocating a pump rod extending downwardly into a well bore for actuating a downhole pump with the cable system including a radially adjustable point of connection with the pair of wheels to vary the stroke of the pump and a pulley and cable system in which one of the pulleys is a traveling pulley having a cable connected thereto extending over a head pulley for connection with the pump rod to provide the desired lifting force and stroke to the pump rod.

Another object of the invention is to provide a well pumping unit in accordance with the preceding object in which the motor for driving the unit is powered from storage batteries connected electrically to a solar powered photovoltaic cell assembly to enable the well pumping unit to operate for long periods of time without replenishment of a fuel supply such as occurs when an internal combustion engine is used to power the pumping unit and without requiring access to an electrical system or a generator unit when using an electric motor to power the pumping unit.

A further object of the present invention is to provide a well pumping unit in accordance with the preceding objects in which the pair of large diameter wheels are independently supported from a skid or platform with a pin connecting the pair of wheels and being mounted between the wheels at radially adjustable points to vary the stroke of the pump rod and to vary the force transmitted to the pump rod.

A still further object of the present invention is to provide a self-contained, portable well pumping unit which is capable of installation in many areas where it is desired to pump fluid from a well or pump other fluids in a desired manner with the pumping unit being dependable in operation, efficient in use, variable in output characteristics and relatively inexpensive to operate and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
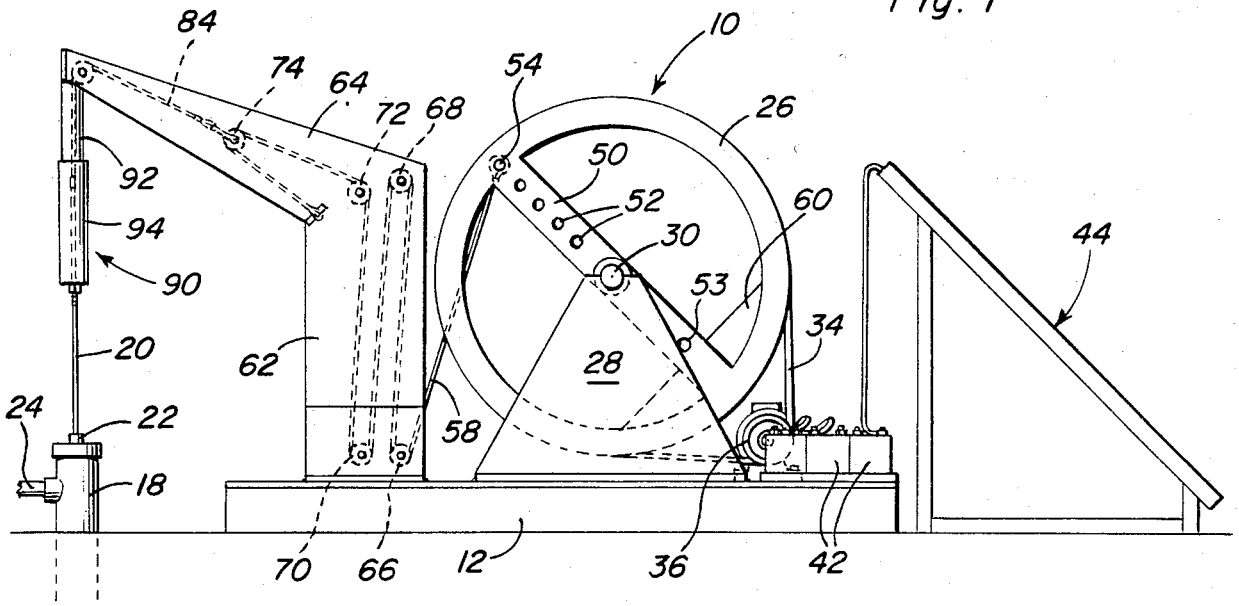
FIG. 1 is a side elevational view of the well pumping unit of the present invention.

Referring now specifically to the drawings, the well pumping unit of the present invention is generally designated by reference numeral 10 and includes a base or skid 12 including a generally horizontally disposed platform 14 which can be transported to a well site and supported in any suitable manner from the ground surface 16 adjacent a well bore and casing 18 which receives a reciprocating pump rod 20 through a stuffing box 22 for producing liquid from the well through a production pipe 24 in a conventional and well known manner with the pumping unit of the present invention reciprocating the pump rod 20 to operate the downhole pump in a manner well known in this art.

Figure 2:
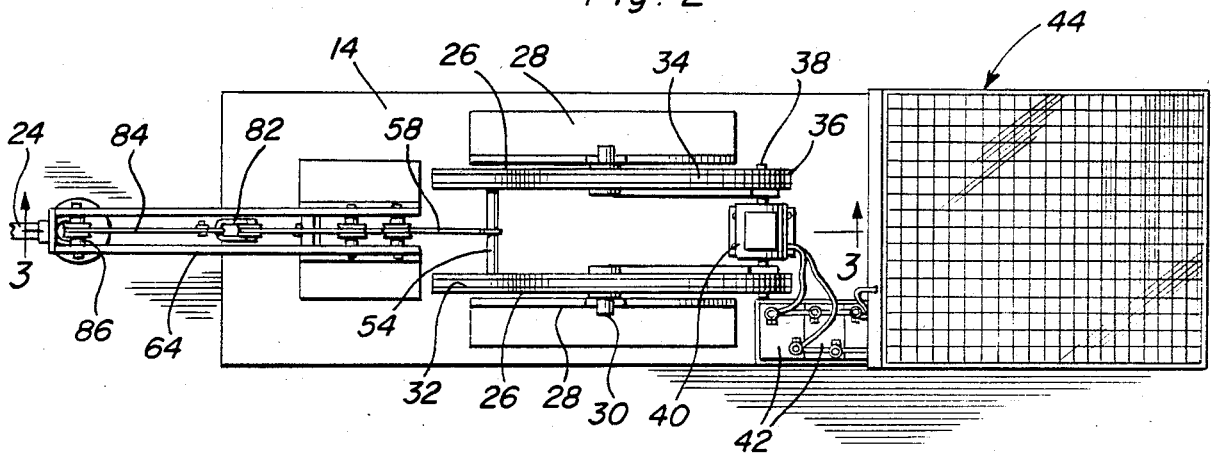
FIG. 2 is a top plan view thereof.
Figure 4:
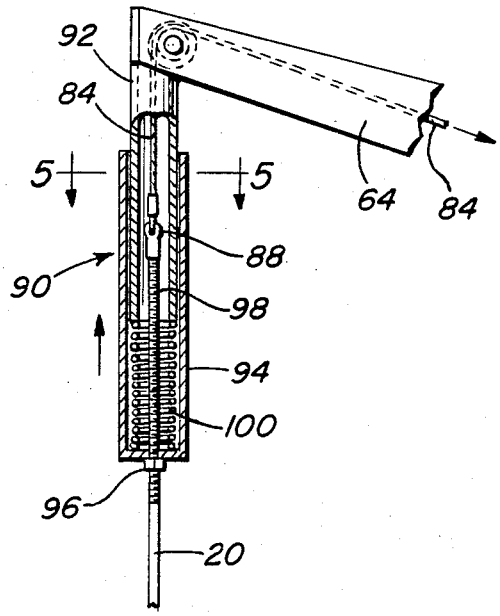
FIG. 4 is a detailed view of the head pulley and pump rod connection system.
Figure 5:
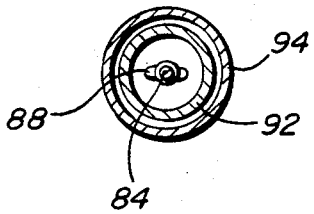
FIG. 5 is a transverse, sectional view, on an enlarged scale, taken substantially upon a plane passing along section line 5—5 of FIG. 4 illustrating the telescopic spring-loaded device associated with the pump rod and cable.
Figure 3:
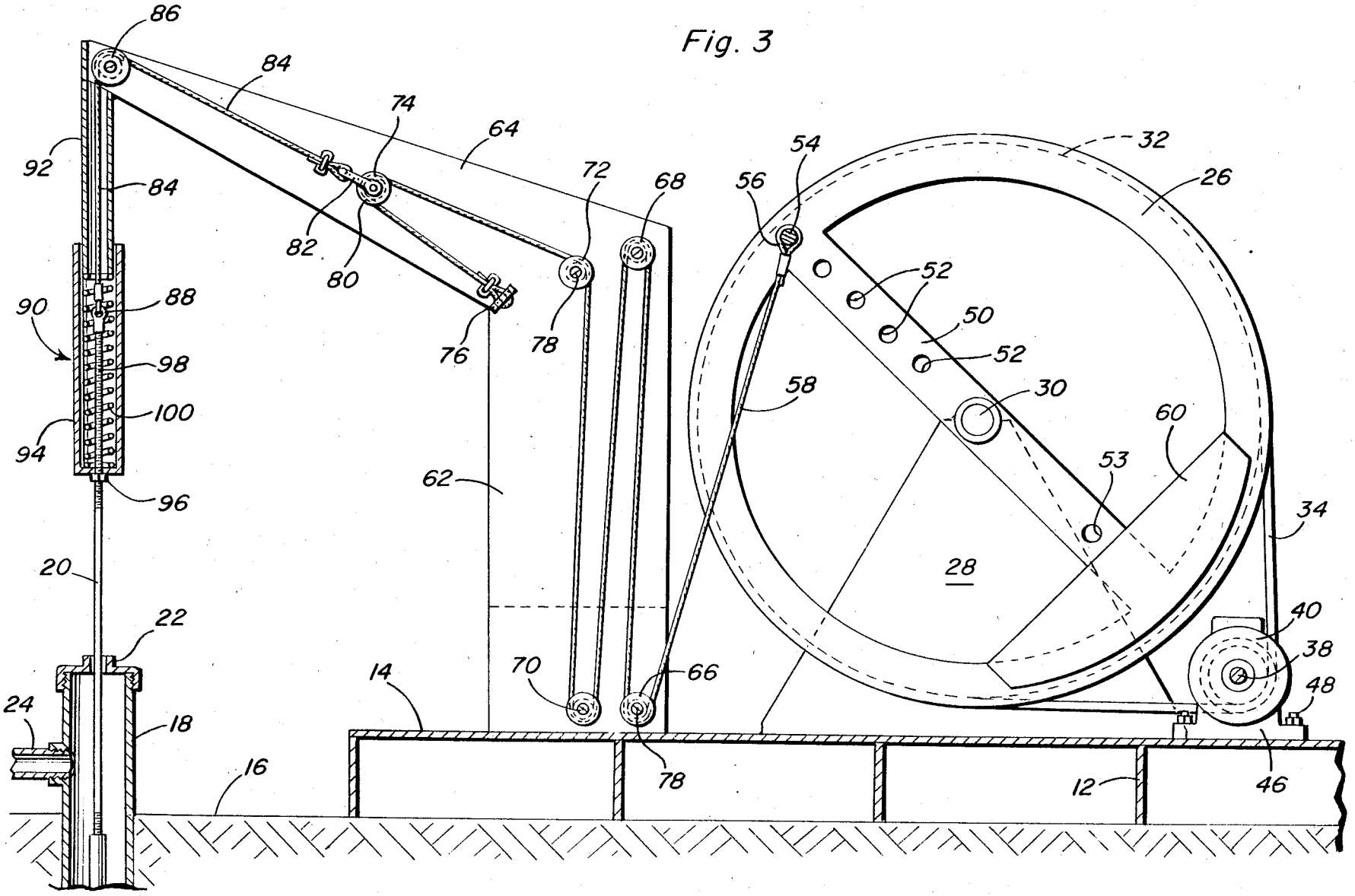
FIG. 3 is a longitudinal, sectional view taken substantially upon a plane passing along section line 3—3 on FIG. 2 illustrating the structural components and their relationship.

The pumping unit 10 includes a pair of large diameter wheels 26 which are spaced from each other as illustrated in FIG. 2 and supported by upstanding support members or stanchions 28 which are rigid with the platform 14 and support stub shafts 30 which journal the wheels 26. Each of the wheels 26 is provided with a peripheral groove 32 receiving a drive belt 34. The drive belts 34 are entrained over pulleys 36 mounted on the outer ends of an output shaft 38 of an electric motor 40. The electric motor 40 may be powered by a plurality of series connected batteries 42 which are electrically connected to a photovoltaic cell assembly 44 so that the batteries 42 will be charged by the use of the solar energy impinging upon the assembly 44 with the output capability of the photovoltaic cell assembly being varied depending upon the requirements of each individual installation and the battery capacity being sufficient to operate the pump during periods of inclement weather and during nighttime or, if desired, an alternate power source may be utilized such as a generator powered by an internal combustion engine which can be used to recharge the batteries 42. The specific details of the solar unit and the batteries are not illustrated since they are conventional in nature and the motor 40 may be supported in an adjustable manner by a supporting base 46 and bolts 48 so that belt tension may be maintained.

The large grooved wheels 26 include at least one radial spoke and preferably a diametric spoke 50 having a plurality of radially spaced openings 52 therethrough which receives a removable pin or shaft 54 with an eye 56 on one end of a cable 58 received on the pin 54 thus enabling the point of connection of the cable 58 to the large wheels 26 to be adjusted radially with respect to the axis of rotation defined by the stub shafts 30 and associated bearing structure at the upper end of the supports 28. The wheels 26 are provided with counterbalance weights 60 thereon to counterbalance the forces encountered by the wheels 26 and to provide smoother rotational motion for the wheels 26 while requiring less energy inasmuch as the counterbalance weights 60 counterbalance the forces exerted by the pump rod 20 on the well pumping unit 10.

The platform 14 is also provided with a pair of upstanding support members 62 which terminate in outwardly extending support members 64 which extend to a position in overlying spaced aligned relation to the pump rod 20. The cable 58 is entrained over a plurality of pulleys 66, 68, 70, 72 and 74 and anchored by an anchor device 76 adjacent the juncture of the vertical support members 62 and the outwardly extending support members 64. The pulleys 66, 68, 70 and 72 are journaled on shafts 78 carried by the support members whereas traveling pulley 74 is journaled on a shaft 80 carried by a shackle 82 connected to a cable 84 which extends over a head pulley 86 supported at the outer end of the support members 64 and extending downwardly therefrom for connection with the upper end of the pump rod 20 by connector 88. The orientation, position and number of the pulleys in the cable system over which cable 58 is entrained may be varied thereby varying the stroke of movement of the pulley 74 and shackle 82 thus varying the stroke of the pump rod 20. This adjustment together with the adjustment of the stroke provided by selectively positioning the pin in one of the radially spaced pairs of holes 52 in the wheels 26 provide for variation in the stroke of the pump rod 20 and variation in the forces exerted on the pump rod 20.

The pump rod 20 and the associated support members 64 includes a return stroke aid generally designated at 90 which includes a small diameter cylindrical tube 92 rigidly affixed to the outer end of the support members 64 and depending therefrom with the cable 84 and connector 88 movable through the center of the tube 92. A larger diameter tube 94 is telescopically received over the tube 92 with the lower end thereof being closed and engaged with a nut 96 threaded on a threaded portion 98 of the pump rod 20. A compression coil spring 100 is positioned in the large tube 94 with the ends of the spring 100 engaging the bottom of the outer telescopic tube 94 and the bottom of the inner telescopic tube 92. Thus, when the pump rod 20 is moved upwardly, it will compress the spring 100 so that the compressed spring 100 will aid in the downstroke of the pump rod 20 rather than relying solely upon gravity to return the pump rod to its lowest position thereby assuring that the cables 84 and 58 will not become loose and also reducing shock on the pump rod and other components which could occur in the event the pump rod 20 does not return downwardly as fast as the movement of the pin 54, cable 58 and cable 84 would permit which could result in an upward force being exerted on the pump rod 20 while it is still moving downwardly.

The pulleys over which the cables pass may be oriented in various positions to adjust the power output characteristics and the number of pulleys may be increased or decreased as desired. The adjustment nut 96 enables the return force exerted on the pump rod to be varied. All of the pulleys may be supported by suitable bearings such as roller bearings, ball bearings and the like and the pulley shafts or axles may be removable to enable replacement of components. The support members 62 and 64 may be provided with guide channels or the like for the cable 58 and cable 84 and suitable lubrication features may be provided where necessary for long lasting operation. In the event it is necessary to pull the pump or pump rod, a pin may be inserted in openings 53 in wheel spoke 50 so that the cable 58 will wind on the pin 54 and the pin inserted in the apertures 53. During normal operation of the wheels 26 to reciprocate the pump rod 20, only the pin 54 will be used as illustrated with the space between the wheels 26 being unobstructed except for the pin 54 so that the cable 58 can move freely as the wheels 26 are rotated. Connection of the cable 58 to the center of the pin 54 with the center location of the cable eye being maintained by any suitable means will assure equal loading on the wheels 26. The dimensional characteristics of the device may vary but in one practical construction, the solar cell assembly 44 may have an output of 12 or 24 volt DC or may be converted to AC with a converter and transformer to obtain any desired output voltage. The wheels may have a diameter up to 80 inches or more with the overall height of the device approaching 8 feet, the overall width, except for the solar unit being 4 feet and the overall length of the platform being 12 feet. As pointed out, these dimensions may vary due to variation in the length of stroke desired and other similar factors.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pump operating unit for reciprocating a pump component operably connected to an output member of the pump operating unit which moves in a reciprocating manner, said pump operating unit comprising a large diameter wheel, a power unit having a small diameter output pulley, a belt encircling the small diameter pulley and large diameter wheel for driving the wheel at a slow rotational speed as compared to the rotational speed of the pulley, an actuating cable, means attaching one end of the cable eccentrically to the large diameter wheel, the other end of the cable being anchored and the intermediate portion of the cable passing over a plurality of pulleys, support means for the wheel, cable pulleys and anchor point for the cable, a traveling pulley engaging a portion of the cable, second cable means forming the output member connected to the traveling pulley and a head pulley supporting the second cable means.

2. The structure as defined in claim 1 wherein radially adjustable means interconnects the wheel and cable to vary the linear movement of the cable during rotation of the wheel.

3. The structure as defined in claim 1 together with a platform rotatably supporting the wheel in vertical position for rotation about a horizontal axis, upstanding support members forming supports for the cable pulleys and cable anchor point.

4. The structure as defined in claim 3 wherein said support members extend upwardly and laterally into overlying relation to a well with the cable means engaged by the traveling pulley extending over said head pulley and being aligned with the well and connected to a pump rod of a downhole pump.

5. The structure defined in claim 4 together with a second wheel of the same diameter as the first-mentioned wheel and supported in parallel facing relation thereto with the space between the wheels being unobstructed except for a transverse pin forming a connection between the two wheels with the end of the cable being attached to the pin.

6. The structure as defined in claim 5 wherein each of said wheels includes a radial spoke having a plurality of radially spaced apertures therein in which the pin may be mounted for varying the linear movement of the cable for each revolution of the wheels thereby varying the pump stroke.

7. The structure as defined in claim 6 wherein said power unit is in the form of an electric motor connected to batteries, and a solar powered photovoltaic cell assembly connected to the batteries for recharging the same.

8. The structure as defined in claim 7 wherein said support members include a depending tube rigid therewith, said pump rod including an adjustable sleeve telescoped over the depending sleeve, and a spring interposed between the sleeves to bias the pump rod downwardly on its return stroke.

9. The structure as defined in claim 8 wherein said wheels include a pin receiving aperture spaced diametrically from the point of attachment with the cable whereby the cable may be wound onto the diametrically opposed pins on the wheels to facilitate pulling of the pump rod and downhole pump.

10. A well pumping unit in which the well includes a downhole pump operated by a reciprocating rod extending above ground, said pumping unit including a supporting structure for positioning adjacent the well, a pair of spaced, grooved, large diameter wheels journaled from the supporting structure for rotation about a horizontal axis, a motor having an output shaft extending transversely of the periphery of the wheels with the shaft including pulleys thereon of smaller diameter than the wheels and disposed in alignment with the wheels, drive belts encircling the pulleys on the motor shaft and the grooved wheels for rotating the grooved wheels, an elongated cable having one end positioned between the wheels, a pin interconnecting the wheels and having one end of the cable connected thereto, said wheels including a plurality of radially spaced apertures for mounting the pin at different positions with respect to the axis of rotation of the wheels for varying the length of movement of the cable during rotation of the wheels, said pin constituting the only structure extending between the wheels to enable the cable to pass across the axis of rotation of the wheels during rotation thereof, said supporting structure including upstanding support members supporting a plurality of vertically and horizontally spaced pulleys over which the cable is entrained with the other end of the cable being anchored to the support members, a traveling pulley engaging the cable between its anchor point and one of the pulleys supported by the support members to maintain the cable taut during rotation of the wheels, a lift cable attached to the traveling pulley and being entrained over a head pulley in alignment with the pump rod and depending therefrom for connection with the pump rod with the positioning of the pulleys, anchor point, point of connection between the cable and wheels and the traveling pulley and head pulley enabling variation of the stroke and power transmitted to the pump rod.

11. The structure as defined in claim 10 whrein the plurality of vertically and horizontally spaced pulleys includes a first pulley oriented at an elevation generally in alignment with the lowermost periphery of the wheels, the portion of the cable engaging the traveling pulley extending from the traveling pulley in generally parallel relation with the lift cable extending in an opposite direction from the portions of the cable engaging the traveling pulley.

12. The structure as defined in claim 11 wherein each of said wheels includes a counterbalancing weight disposed diametrically opposite to the pin interconnecting the wheels.

13. The structure as defined in claim 12 wherein said support members include a depending tube rigid therewith receiving the lift cable, the pump rod including an adjustable sleeve telescoped over the depending sleeve, and a spring interposed between the sleeve and tube to bias the pump rod downwardly during its return stroke.

14. The structure as defined in claim 13 wherein said wheels include apertures oriented diametrically from the pin for receiving a second transverse pin on the opposite side of the axis of rotation to enable the cable to be wound onto the pins between the wheels for lifting the pump rod.

* * * * *